US008439048B2

(12) United States Patent
Tranchant et al.

(10) Patent No.: US 8,439,048 B2
(45) Date of Patent: May 14, 2013

(54) DEVICE FOR APPLYING A COSMETIC COMPOSITION THAT INCLUDES MAGNETIC PARTICLES, AND AN ASSEMBLY INCLUDING THE DEVICE

(75) Inventors: Jean-Francois Tranchant, Marigny-les-Usages (FR); Marc Chevalier, Franconville (FR)

(73) Assignee: LVMH Recherche, Saint Jean de Braye (FR)

( * ) Notice: Subject to any disclaimer, the term of this patent is extended or adjusted under 35 U.S.C. 154(b) by 229 days.

(21) Appl. No.: 12/825,696

(22) Filed: Jun. 29, 2010

(65) Prior Publication Data

US 2011/0000498 A1 Jan. 6, 2011

(30) Foreign Application Priority Data

Jul. 2, 2009 (FR) ..... 09 54537

(51) Int. Cl.
*A45D 40/26* (2006.01)
*A45D 24/04* (2006.01)
*A45D 24/12* (2006.01)

(52) U.S. Cl.
USPC ..... 132/218; 401/126; 401/130

(58) Field of Classification Search ..... 132/218, 132/320, 317; 401/126–130
See application file for complete search history.

(56) References Cited

U.S. PATENT DOCUMENTS

| | | | |
|---|---|---|---|
| 2001/0033766 | A1 | 10/2001 | Gueret |
| 2006/0088483 | A1 | 4/2006 | Thevenet |
| 2007/0125396 | A1 | 6/2007 | Ramet |
| 2007/0227553 | A1 | 10/2007 | Gueret |
| 2008/0003046 | A1 | 1/2008 | Gueret |
| 2008/0038043 | A1 | 2/2008 | Tranchant |

FOREIGN PATENT DOCUMENTS

| | | | |
|---|---|---|---|
| EP | 1 611 817 | A1 | 1/2006 |
| EP | 1 728 235 | A2 | 11/2006 |
| EP | 1 785 055 | A1 | 5/2007 |

OTHER PUBLICATIONS

French Preliminary Search Report from priority application No. FR 09 54537; Report dated Apr. 14, 2010.
Written Opinion from priority application No. FR. 09 54537.

*Primary Examiner* — Robyn Doan
(74) *Attorney, Agent, or Firm* — Miller Matthias & Hull LLP

(57) ABSTRACT

A device for applying a cosmetic composition including magnetic or magnetizable particles, said applicator device comprising handle means and an applicator head including an applicator surface and a magnetic device suitable for generating a magnetic field, and the applicator head further including a setback forming a reservoir suitable for containing said cosmetic composition, said reservoir being located in the applicator surface and having a bottom. The bottom of the reservoir is movable relative to the applicator surface by an adjuster device associated with the applicator head.

13 Claims, 4 Drawing Sheets

DEVICE FOR APPLYING A COSMETIC COMPOSITION THAT INCLUDES MAGNETIC PARTICLES, AND AN ASSEMBLY INCLUDING THE DEVICE

CROSS-REFERENCE TO RELATED APPLICATIONS

This application claims priority under the Paris Convention and 35 USC §119 to French Application No. 09 54537, filed on Jul. 2, 2009.

FIELD OF THE DISCLOSURE

The invention relates to an applicator device for the purpose of applying a cosmetic composition that includes particles that are magnetic or magnetizable, and it also relates to an assembly including the applicator device. The invention relates to applying cosmetic compositions that have a wide range of viscosities, and it therefore also covers applicator devices for applying cosmetic compositions that are pasty.

BACKGROUND OF THE DISCLOSURE

Document EP-1 129 640 discloses an applicator device including handle means and an applicator head having a magnetic device suitable for generating a magnetic field and having an applicator surface that is generally porous.

Such an applicator device makes it possible to take a cosmetic composition that includes magnetic particles from a container and to apply the composition to the eyelashes, the lips, or the skin. Nevertheless, such a device does not enable a film of composition to be deposited under good conditions for preserving glossiness, in particular.

Furthermore, document FR-2 889 921 discloses both an assembly including a non-magnetic applicator for use in a first step to apply magnetic particles that also have optical properties in terms of reflecting and/or diffracting light, such as certain nacres, for example, and also a magnetic device that is suitable for imparting a determined orientation to the magnetic particles in a second step in order to obtain the looked-for visual effect.

Furthermore, document EP-1 726 235 discloses an applicator device for applying a cosmetic composition including magnetic or magnetizable particles, said applicator device including handle means and an applicator head having a magnetic device suitable for generating a magnetic field, said applicator head having an applicator surface and also including a setback forming a reservoir suitable for containing the cosmetic composition, said reservoir being disposed in the applicator surface and having a bottom.

SUMMARY OF THE DISCLOSURE

An object of the invention is to make it easier both to apply the composition and also to improve the deposition of magnetic or magnetizable particles on keratinous fibers in order to obtain the visual effect that is created by the cosmetic composition when it includes magnetic particles having an optical effect by reflecting and/or diffracting light.

To this end, in accordance with the invention, the bottom of the reservoir is movable relative to the applicator surface by an adjuster device connected to the applicator head.

Thus, it is easy to deposit the desired quantity of cosmetic composition while simultaneously orienting the magnetic or magnetizable particles while they are being deposited so as to obtain the looked-for optical effect in more effective manner.

In particular, when the cosmetic composition is a liquid in which the particles can be moved under the action of a magnetic field, the present invention enables a film to be deposited on a film with better quality and with a final appearance effect that is generally better. This type of applicator device is also better adapted to compositions having a drying time that is short and therefore unsuitable for obtaining the optical effect after the composition has been applied, unlike devices of the prior art. In addition, the quantity (thickness) of the composition that the user seeks to deposit may be adapted by adjusting the depth of the reservoir.

Naturally, it should be understood that the user has different positions available for adjusting the position of the bottom of the reservoir relative to the applicator surface, and that the adjuster device (when the user is not taking any action on the adjuster device) holds the bottom of the reservoir (in the adjustment position selected by the user acting on the adjuster device) relative to the applicator surface (independently of the quantity of composition contained in the reservoir).

According to an additional characteristic in accordance with the invention, the applicator surface preferably extends all around the reservoir.

This makes it even easier to deposit the cosmetic composition uniformly with its magnetic particles well oriented.

According to another additional characteristic, the bottom of the reservoir is preferably set back from the applicator surface by a distance that is substantially constant.

The deposit of the cosmetic composition is thus further improved, thereby contributing to producing a more satisfactory appearance effect.

According to another characteristic in accordance with the invention, the applicator surface is preferably concave.

Application of the cosmetic composition on the surface of the body is thus better controlled.

According to an additional characteristic, and preferably, the adjuster device includes a stud that slides in a groove having notches.

This solution is simple, effective, and easy to use for placing and holding the bottom of the reservoir in the desired position relative to the applicator surface.

In various embodiments, the applicator device may advantageously have one and/or more of the following provisions:

the magnetic device is made of a ferromagnetic material or of a material including magnetic or magnetizable particles suitable for generating a magnetic field;

the magnetic device constitutes the bottom of the reservoir; and the magnetic device generates a magnetic field in a direction that is substantially perpendicular to the application surface.

The invention also provides an assembly comprising both the above-specified applicator device and a container provided with a cap for closing the container, said container containing a cosmetic composition that includes magnetic or magnetizable particles.

In various embodiments, the assembly may advantageously have one and/or more of the following provisions:

the magnetic or magnetizable particles included in the cosmetic composition are movable so as to be oriented under the effect of a magnetic field and also have optical properties in terms of reflecting and/or diffracting light that differ depending on the orientation that is imparted thereto by the magnetic device; and the applicator device comprises a holder stem extending in a long direction between a proximal end and a distal end, the applicator head being held at the distal end of the handle device and the cap closing the container is held at the proximal end of said handle stem.

The invention also provides a method of applying makeup using the above-specified assembly. In accordance with the invention, the cosmetic composition including the magnetic or magnetizable particles is applied and the magnetic or magnetizable particles are simultaneously oriented under the effect of the magnetic device.

BRIEF DESCRIPTION OF THE DRAWINGS

Other characteristics and advantages of the present invention appear from the following detailed description given with reference to the accompanying drawings, in which.

DETAILED DESCRIPTION

Figure 1:
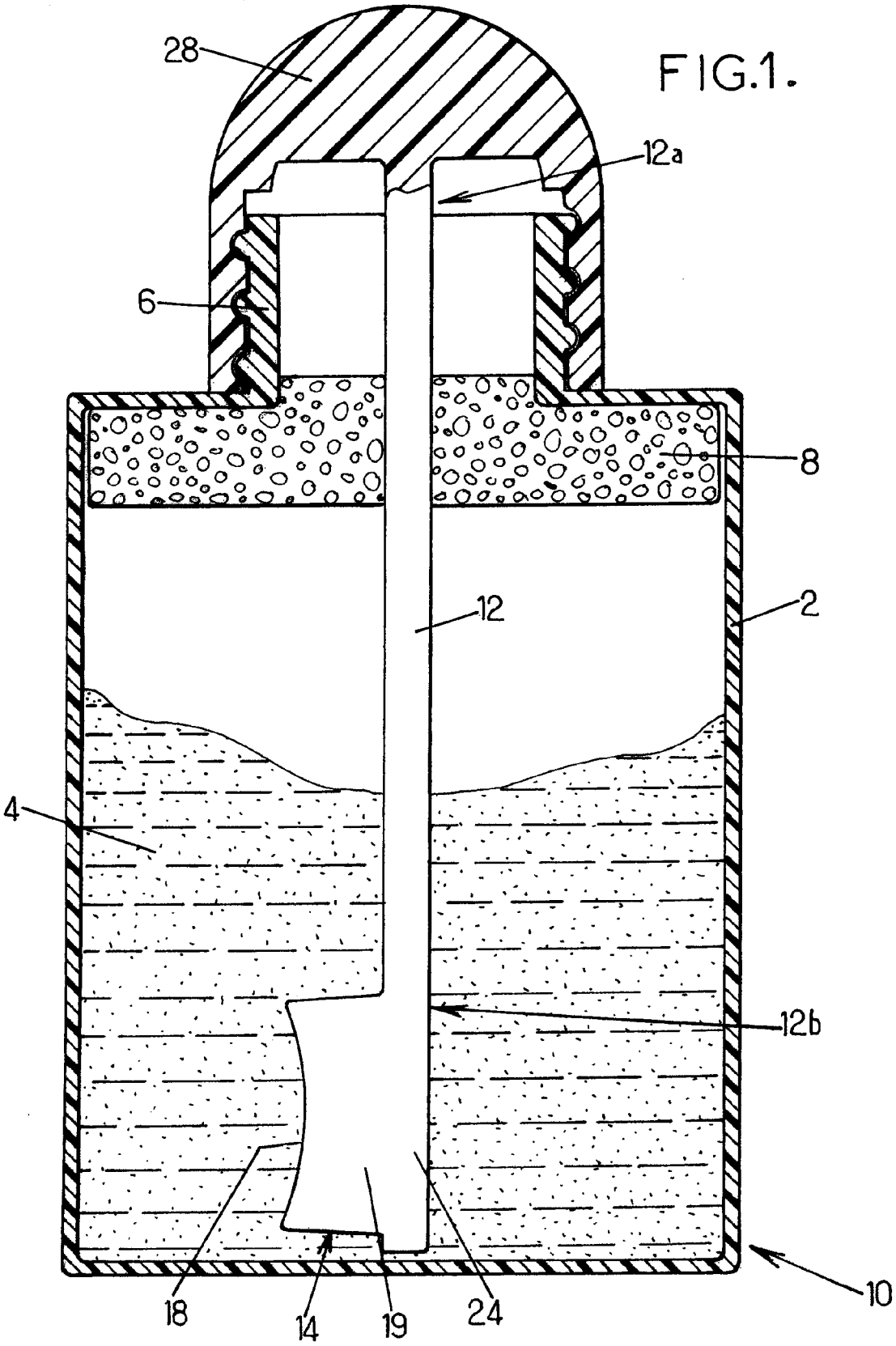
FIG. 1 shows an assembly in accordance with the invention including an applicator device.

FIG. 1 shows an assembly 10 essentially comprising an applicator device 1 and a container 2 containing a cosmetic composition 4, in particular mascara, the composition including magnetic particles.

Figure 2:
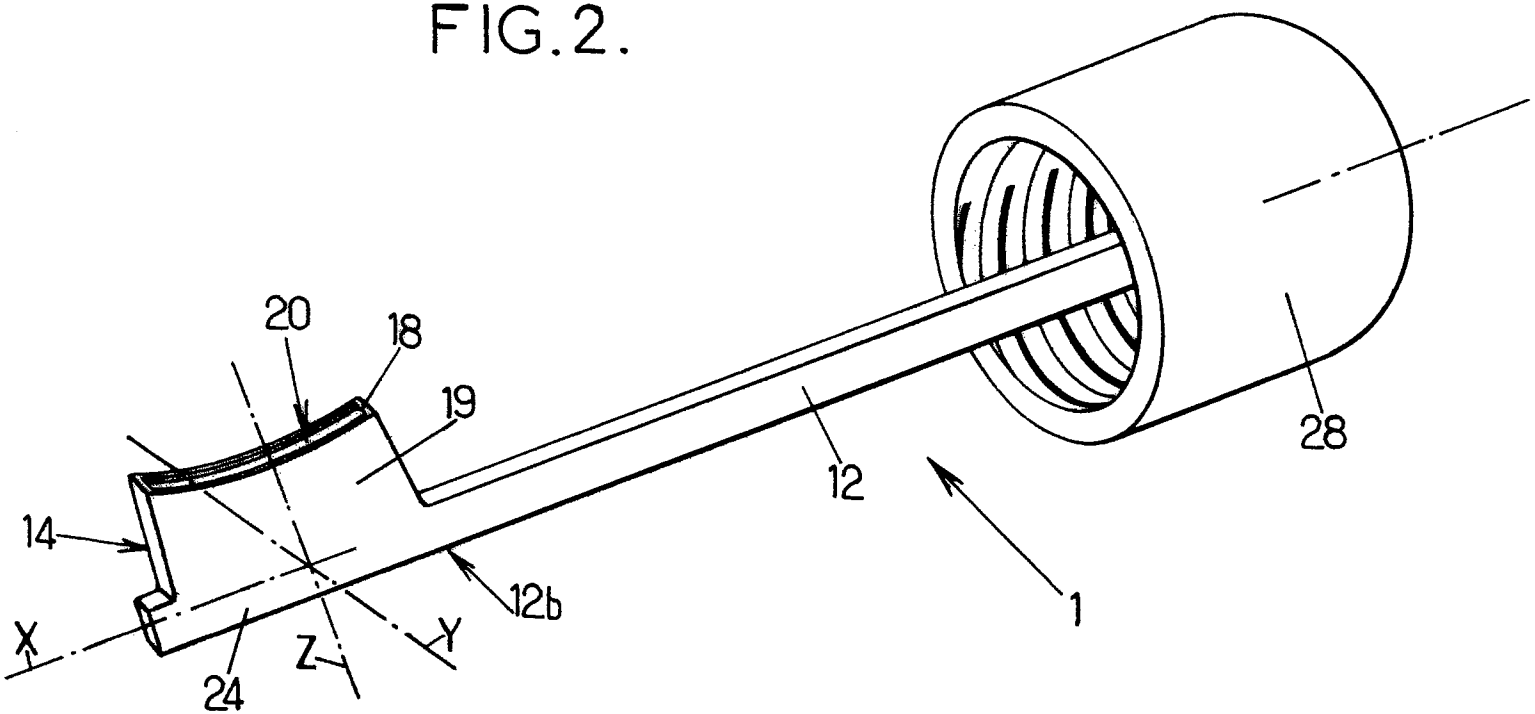
FIG. 2 shows the applicator device in perspective.

As shown in particular in FIGS. 1 and 2, the applicator device 1 essentially comprises a handle stem 12, an applicator head 14, and a cap 28. In the embodiment shown, the cap 28 is integral with the handle stem 12.

As shown in FIG. 1, the container 2 has a neck 6 through which the applicator device 1 is adapted to be inserted into the container 2 and on the outside of which the cap 28 is suitable for screw-fastening to close the container 2. In addition, the container 2 is provided with a wiper device 8 located close to the neck 6 in order to remove excess cosmetic composition 4 that is to be found on the applicator device 1 prior to its extraction from the container 2. The wiper device 8 is constituted by a relatively flexible material that closes the neck 6 and that deforms elastically when the applicator head 14 passes through. In the embodiment shown, the wiper device 8 is constituted by a flexible foam. In a variant, the wiper device could be constituted by bristles or by any other means suitable for performing an analogous function.

Figure 3:
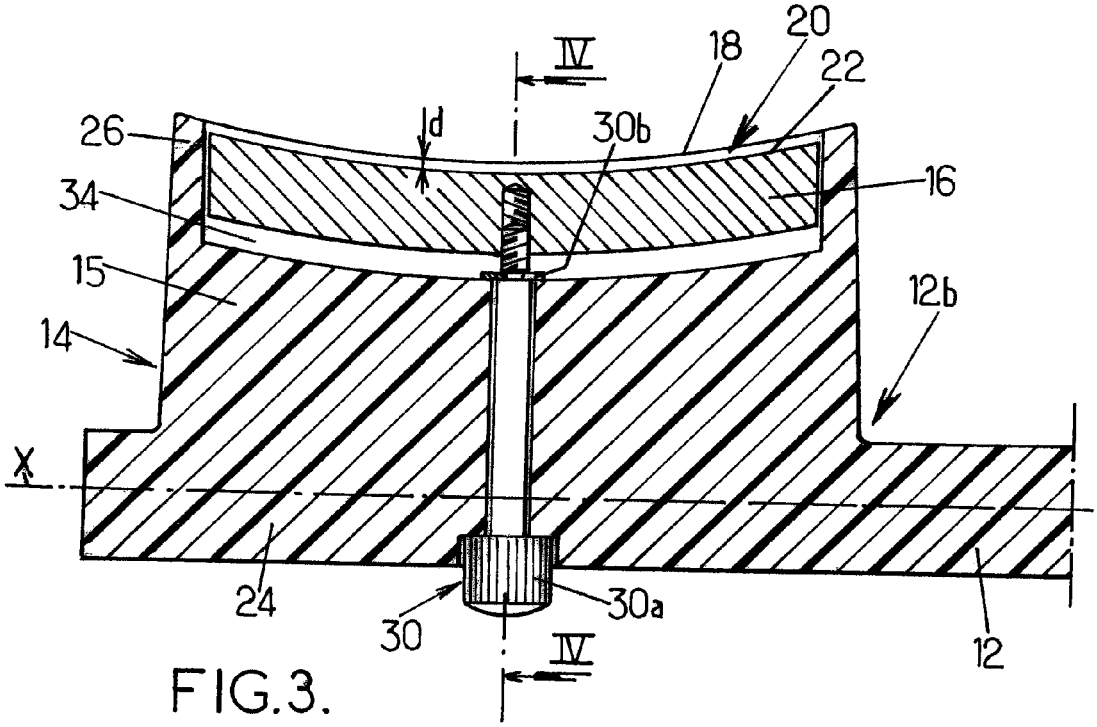
FIG. 3 shows a portion of the applicator device in section on the line marked III-III in FIG. 4.
Figure 4:
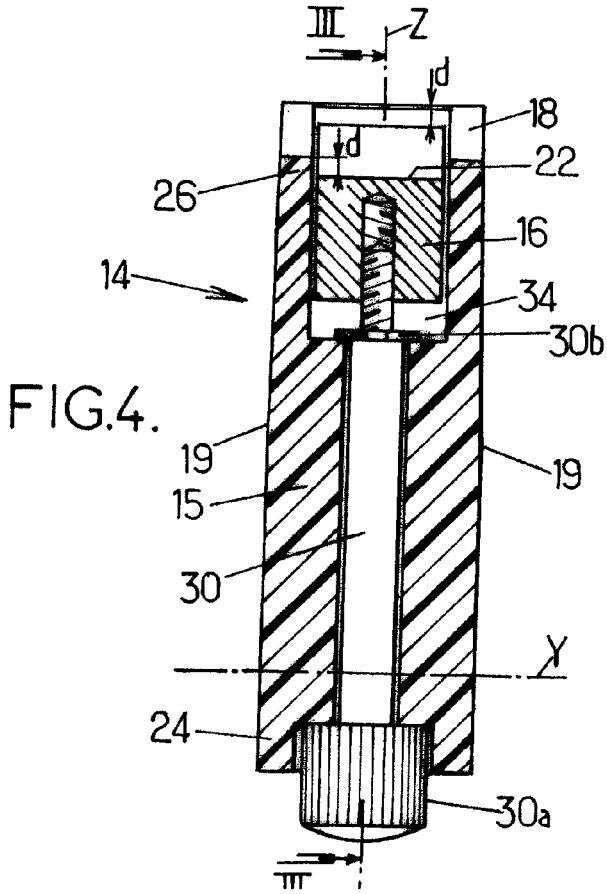
FIG. 4 shows the applicator device in section on the line marked IV-IV in FIG. 3.

As shown in FIGS. 2 to 4, the handle stem 12 extends in a long direction X between a proximal end 12*a* and a distal end 12*b*. It is long and thin and has a section that is substantially constant going along the long direction X. The cap 28 is formed integrally with the proximal end 12*a* of the stem 12, while the applicator head 14 is secured to the distal end 12*b* of the handle stem 12.

The applicator head 14 comprises a holder 15 and a magnet 16. In the embodiment shown, the holder 15 is formed integrally with the handle stem 12 and the cap 28. The holder 15 is generally prismatic in shape, substantially cylindrical with generator lines extending in an elevation direction Z that is perpendicular to the long direction X. The holder 15 extends along the elevation direction Z from a base 24 to an applicator surface 18. The base 24 is rectangular and elongate in the long direction X. The base 24 extends the handle stem 12 without forming any step relative to the handle stem 12. Thus, in a transverse direction Y that is perpendicular to the long direction X and to the elevation direction Z, the base 24 has a width that is equal to the width of the handle stem 12.

The holder 15 of the applicator head 14 is not exactly cylindrical, but it tapers slightly, having a truncated pyramid shape with its section perpendicular to the elevation direction Z becoming smaller on going towards the applicator surface 18.

The holder 15 has a housing 34 defined at its periphery by an enclosure 26 in which the magnet 16 is placed. The applicator surface 18 extends to the free end of the enclosure 26, all around a reservoir 20, and the magnet 16 has a surface 22 facing out from the housing 34 and set back in the elevation direction Z from the applicator surface 18. This surface of the magnet 16 defines the bottom 22 of the reservoir 20 which is otherwise defined by the enclosure 26 and the applicator surface 18.

The applicator surface of the holder 15 may be covered in a flexible material, advantageously a material having a modulus of elasticity of less than 300 megapascals (MPa) at 20° C. This deposit of flexible material forms annular "lips", which are preferably made of silicone, for the purpose of smoothing the free edges of the enclosure 26. Reference may be made to document FR-2 901 458 for more ample information.

The applicator surface 18 is concave and curved in the long direction X. The bottom 22 of the housing 20 is also concave and curved in the long direction X. The bottom 22 extends at a distance d from the applicator surface 18, and the distance d is substantially constant along the long direction X.

The distance d is adjustable by means of a screw 30 extending in the elevation direction Z, passing through the holder 15 and screwed into the magnet 16. The screw 30 has a head 30*a* and an annular groove in which a resilient retaining ring 30*b* is received. The screw 30 is held to the holder 15 by its head 30*a* and by the resilient retaining ring 30*b*.

By taking hold of the head 30*a* of the screw 30 in order to turn it around the elevation direction Z, the user can vary the distance d, in other words the user can vary the depth of the reservoir 20 at will. Preferably, the distance d lies in the range 1 millimeter (mm) to 5 mm. By adjusting the height d, the user is thus capable of adapting the applicator device as a function of the intended application (mascara, nail varnish, lipstick, eye shadow, etc.) and as a function of the rheological characteristics of the composition (most particularly its viscosity).

Thus, in particular for a cosmetic composition 4 that is liquid, the user can reliably deposit a film on a film.

The cosmetic composition 4 may also be a powder or some other appropriate cosmetic composition. When the cosmetic composition is a powder, the applicator device 1 enables free powder to be stored effectively in the reservoir 20 and to be concentrated over a small area for application purposes.

The holder 15 also has two main outside surfaces 19 on its outside that extend in the long direction X and in the elevation direction Z.

The cosmetic composition 4 preferably includes iron oxides ($Fe_3O_4$) that give it magnetic properties, or some analogous ingredient. Advantageously, the cosmetic composition includes nacres containing said iron oxides or the like.

The magnet 16 is preferably a permanent magnet that generates a magnetic field in the elevation direction Z.

Figure 5:
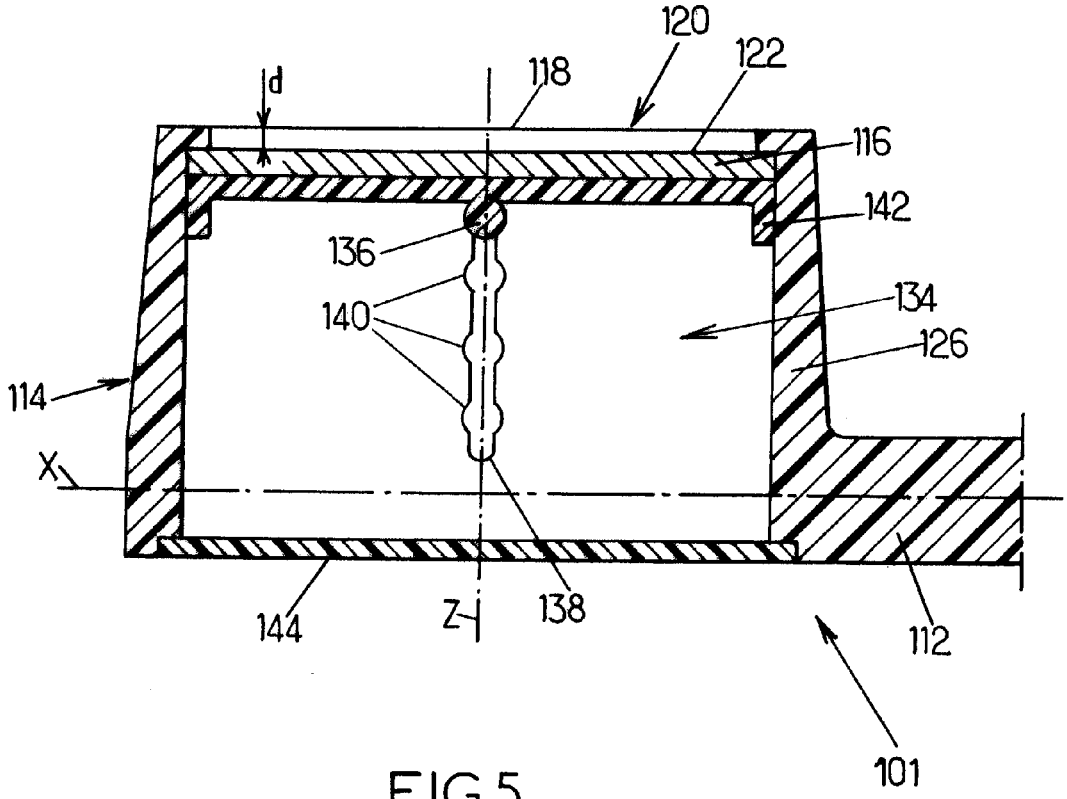
FIG. 5 shows a variant of the applicator device in accordance with the invention, this view corresponding to FIG. 3.

FIG. 5 shows a variant of the applicator device 101. Elements of the applicator device 101 that correspond to elements of the applicator device 1 have the same reference numerals plus 100.

The applicator device 101 has a handle stem 112 and an applicator head 114. The applicator head 114 has a holder 115 and a magnet 116. The holder 115 extends along the elevation direction Z from a base 124 to an applicator surface 118 that is elongate in the long direction X.

The holder 115 has a housing 134 defined peripherally by an enclosure 126, and the magnet 116 is placed therein. The applicator surface 118 extends at the free end of the enclosure 126 all around a reservoir 120, and the magnet 116 has a surface 122 facing out from the housing 134 and set back at a distance d in the elevation direction Z from the applicator surface 118. This surface of the magnet 116 defines the bottom 122 of the reservoir 120, which is otherwise defined by the enclosure 126 and by the applicator surface 118. The applicator surface 118 and the bottom 122 of the housing 120 are plane in the embodiment shown.

The magnet 116 is carried by a slider 142 secured to the magnet 116 and suitable for sliding in the housing 134 in the elevation direction Z. The enclosure 126 has a groove 138 both receiving a stud 136 secured to the slider 142 and having notches 140 for holding the stud 136, and thus for holding the magnet 116 set back from the applicator surface 118 by the selected distance d.

For reasons of appearance, the housing 134 is closed at the base 124 by a cover 144.

Naturally, the invention is not limited in any way to the embodiment described above by way of non-limiting illustration. Thus, although not preferred, instead of extending all around the reservoir 20, the applicator surface 18 need only extend along one or more edges of the reservoir.

In addition, instead of being concave and curved like the applicator surface 18, the bottom 22 of the reservoir 20 could have a serrated surface, e.g. having a section in the long direction X that is of sinusoidal shape, or comprising a succession of triangles, or the like. Such a shape encourages retention of the composition in the reservoir 20.

The applicator surface 18 could include slots in the elevation direction Z so as to form a kind of mascara comb for application to the eyelashes.

The cap 28 and the handle stem 12 could be separate from each other, the applicator device then being held directly by the user gripping the handle stem 12 at its proximal end 12*a*, after removing the cap 28.

In addition, the magnet 16 could be replaced by a part having the same shape but no magnetic properties, with the magnetic field being created by magnetic particles that are dispersed in the holder 15.

We claim:

1. An applicator device for applying a cosmetic composition including magnetic or magnetizable particles, said applicator device including a handle and an applicator head having a magnetic device suitable for generating a magnetic field, said applicator head having an applicator surface and also including a setback forming a reservoir suitable for containing the cosmetic composition, said reservoir being disposed in the applicator surface and having a bottom included in the applicator head, wherein the bottom of the reservoir is movable relative to the applicator surface by an adjuster device connected to the applicator head and the magnetic device constitutes the bottom of the reservoir.

2. The applicator device according to claim 1, wherein the applicator surface extends all around the reservoir.

3. The applicator device according to claim 2, wherein the bottom of the reservoir is set back from the applicator surface by a distance that is substantially constant.

4. The applicator device according to claim 3, wherein the bottom of the reservoir is set back from the applicator surface by a distance between 1 millimeter and 5 millimeters.

5. The applicator device according to claim 1, wherein the applicator surface is concave.

6. The applicator device according to claim 1, wherein the adjuster device includes a stud that slides in a groove having notches.

7. The applicator device, according to claim 1, wherein the magnetic device is made of a ferromagnetic material or of a material including magnetic or magnetizable particles suitable for generating a magnetic field.

8. The applicator device according to claim 1, wherein the magnetic device generates a magnetic field in a direction that substantially perpendicular to the application surface.

9. The applicator device according to claim 1, wherein the applicator device includes a handle stem extending in a long direction between a proximal end and a distal end, the applicator head being held at the distal end of the handle stem.

10. An assembly comprising:

an applicator device for applying a cosmetic composition including magnetic or magnetizable particles, said applicator device including a handle and an applicator head having a magnetic device suitable for generating a magnetic field, said applicator head having an applicator surface and also including a setback forming a reservoir suitable for containing the cosmetic composition, said reservoir being disposed in the applicator surface and having a bottom included in the applicator head wherein the bottom of the reservoir is movable relative to the applicator surface by an adjuster device connected to the applicator head and the magnetic device constitutes the bottom of the reservoir, and a container having a neck through which the applicator device is adapted to be inserted into the container and a cap for closing the container, said container containing a cosmetic composition that includes magnetic or magnetizable particles.

11. The assembly according to claim 10, wherein the magnetic or magnetizable particles included in the cosmetic composition are movable so as to be oriented under the effect of a magnetic field and also have optical properties in terms of reflecting and/or diffracting light that differ depending on the orientation that is imparted thereto by the magnetic device.

12. The assembly according to claim 10, wherein the applicator device comprises a holder stem extending in along direction between a proximal end and a distal end, the applicator head being held at the distal end of the handle device and the cap closing the container is held at the proximal end of said handle stem.

13. A method of applying makeup using an assembly comprising:

a container having a cap for closing the container, said container containing a cosmetic composition that includes magnetic of magnetizable particles, and an applicator device for applying the cosmetic composition, said applicator device being adapted to be inserted into and extracted from the container, said applicator device including a handle and an applicator head having a magnetic device suitable for generating a magnetic field, said applicator head having an applicator surface and also including a setback forming a reservoir suitable for containing the cosmetic composition, said reservoir being disposed in the applicator surface and having a bottom included in the applicator head, wherein the bottom of the reservoir is movable relative to the applicator surface by an adjuster device connected to the applicator head and the magnetic device constitutes the bottom of the reservoir, wherein the cosmetic composition including the magnetic or magnetizable particles is applied and the magnetic or magnetizable particles are simultaneously oriented under the effect of the magnetic device.

* * * * *